US007677967B2

(12) United States Patent
Jessop et al.

(10) Patent No.: US 7,677,967 B2
(45) Date of Patent: Mar. 16, 2010

(54) BATTLE SCHOOL

(76) Inventors: Louis G. Jessop, 11030 S. 1364 West, South Jordan, UT (US) 84095; Paul D. Noble, 5082 W. Eagle Hill Cir., West Jordan, UT (US) 84084; Daniel E. Loveridge, 10444 Dimple Dell Rd., Sandy, UT (US) 84092

( * ) Notice: Subject to any disclaimer, the term of this patent is extended or adjusted under 35 U.S.C. 154(b) by 375 days.

(21) Appl. No.: 11/456,179

(22) Filed: Jul. 7, 2006

(65) Prior Publication Data

US 2008/0020367 A1 Jan. 24, 2008

(51) Int. Cl.
*A63F 13/00* (2006.01)

(52) U.S. Cl. ..... 463/9; 434/323

(58) Field of Classification Search ..... 463/9; 434/236

See application file for complete search history.

(56) References Cited

U.S. PATENT DOCUMENTS

| | | | | |
|---|---|---|---|---|
| 5,465,982 | A | 11/1995 | Rebane | 273/433 |
| 5,630,754 | A | 5/1997 | Rebane | 463/9 |
| 5,697,844 | A | 12/1997 | Von Kohorn | 463/40 |
| 5,916,024 | A | 6/1999 | Von Kohorn | 463/40 |
| 5,947,747 | A * | 9/1999 | Walker et al. | 434/354 |
| 6,343,319 | B1 | 1/2002 | Abensour | 709/219 |
| 6,554,618 | B1 | 4/2003 | Lockwood | 434/322 |
| 6,561,811 | B2 | 5/2003 | Rapoza | 434/236 |
| RE38,432 | E | 2/2004 | Fai | 434/350 |
| 6,688,888 | B1 | 2/2004 | Ho | 434/322 |
| 6,688,891 | B1 | 2/2004 | Sanford | 434/365 |
| 6,847,938 | B1 | 1/2005 | Moore | 705/26 |
| 6,909,874 | B2 | 6/2005 | Holtz | 434/362 |
| 7,303,398 | B2 * | 12/2007 | Soto | 434/128 |
| 2007/0238079 | A1 * | 10/2007 | Harrison | 434/236 |

OTHER PUBLICATIONS

*Video Games in Education*, http://www3.essdack.org/socialstudies/videogames.htm, p. 1-5.

* cited by examiner

*Primary Examiner*—Dmitry Suhol
*Assistant Examiner*—Thomas H Henry
(74) *Attorney, Agent, or Firm*—Workman Nydegger

(57) ABSTRACT

Educational materials are presented in the format of games such as role-playing where participants progress through game storylines within a game environment. Each game participant is assigned a game character having unique and dynamic attributes that can be modified as the character progresses through the game storylines. The characters encounter challenges and participate in game actions that require the participant to answer questions that correspond to educational materials that are contextually unrelated to the game storylines. In order to successfully modify a character's attributes, obtain possessions for the character, progress through the storyline, to be successful in battle sequences or to obtain a desired reward, the participants must correctly answer the questions they are presented. To obtain a successful result, it is also sometimes necessary for a participant to recruit other participants having different assigned characters with different attributes to collaborate and work with the participant.

24 Claims, 2 Drawing Sheets

BATTLE SCHOOL

CROSS-REFERENCE TO RELATED APPLICATIONS

N/A

BACKGROUND

The present invention relates to games, as well as methods, systems, and computer-program products for promoting educational interests and social development through the use of games.

While the educational and gaming industries often find themselves at odds, competing for the time and attention of the younger generation, it will be appreciated that there are many opportunities for these industries to cooperatively work together in the development of new and exciting educational games. This is particularly true in view of the technological advances that have been made with the computing and communications devices that are heavily leveraged by the educational and gaming industries.

Improvements in technology have also reduced the manufacturing costs to the point that it is now relatively affordable for every household to own one or more computing devices. The affordability of manufacturing new and exciting technology is also readily apparent in the sheer volume of gaming and multimedia consoles that are manufactured solely for entertainment purposes.

While it can certainly be argued that technology has enhanced our educational and entertainment opportunities, it can also be argued that the excessive abundance of new and exciting technologies in the entertainment industry has actually had a negative impact on the educational and social development of our youth. For example, many youth spend more time watching television, surfing the Internet and playing video games than they spend in school, playing outside or working.

This new socio-technological environment that children are now exposed to provides many obstacles and challenges to their learning and social development. Among other things, the ever limited attention span of our youth appears to shrink even more in the presence of the new and exciting movies, games and other entertainment that is continually being presented in increasingly more affordable and convenient ways.

The difficulty for students to maintain the appropriate level of concentration, which is required to learn in this technologically advanced era, is particularly noticeable when the students are required to learn from traditional and, arguably, less stimulating teaching methods.

Technological advances have also had a significant influence on the manner in which we communicate. For example, it is now typical to use computing devices to communicate through email, telephone text-messaging, instant messaging and so forth. However, while computing devices can improve the ease and convenience of communicating, the increased use of computing devices for communication can also have a negative impact on the development of certain social skills. In particular, the increased use of computing devices to communicate can reduce the duration and frequency of face-to-face experiences that are sometimes necessary to develop and learn fundamental social skills. In fact, it is somewhat ironic that while computers have drastically improved the convenience of communicating with distant peoples in remote places, they have also created a crutch and refuge for further isolating the socially challenged people that we live with in our own communities.

The Internet, the television and personal gaming consoles have also reduced the demand for social interaction since many people find electronic entertainment to be a convenient and adequate substitution for social stimulation.

Notwithstanding these increasingly noticeable and grievous side effects of certain technologies, particularly in the entertainment industry, there does not appear to be any immediate end in sight. In fact, to the contrary, all signs appear to indicate that the entertainment industry will continue making new products that feed our insatiable demand for convenient and exciting entertainment.

In view of the foregoing, there is clearly a need to provide new and exciting teaching techniques, as well as opportunities for social interaction, which are capable of competing with the entertainment industry. It would also be desirable to provide new educational tools and techniques that utilize the technological advances that have been developed in the gaming industry and that utilize the technological experiences and skills possessed by children that are exposed to technologically advanced environments and devices.

BRIEF SUMMARY

This Summary is intended to introduce a selection of concepts in a simplified form that are further described in the Detailed Description below. This Summary is not intended to identify key features or essential features of the claimed subject matter, nor is it intended to be used as an aid in determining the scope of the claimed subject matter.

As described below, embodiments of the present invention include various new and unique methods, systems and computer-program products for promoting educational interests and social development through the use of games, such as, for example, role-playing games.

In some embodiments, educational materials are presented in the format of a game where participants socially interact within a game environment. The game environment can be modeled after another environment that is familiar to the game participants, such as a school environment, a workplace, a home environment or any other environment.

Each game participant is assigned a game character from a plurality of characters that have unique attributes (e.g., strengths, weaknesses, and other characteristics). In some embodiments, the characters are dynamic inasmuch as their defined attributes can be developed or otherwise modified over time, such as, for example, as the character progresses through a storyline of the game.

The assignment of a character to a participant is based on any combination of factors, such as the participant's affinity for a particular character, based on a strategy, based on a requirement, and so forth. To facilitate a broad selection of characters, the characters can be modeled after different personality types, interests, job descriptions, roles, demographics and other factors.

In some embodiments, the participants are exposed to a storyline within a hypothetical environment in which their character must perform a feat, complete a quest, master a particular skill, engage in battle or participate in another game activity or action. During the game, the participants are also exposed to educational materials that must be mastered in order for their character to progress thru the storyline or to obtain a desired reward or result within the game environment. A reward can also be a desired movement on a game board, when the game is played on a board.

In some embodiments, the participants character must recruit and work with other characters assigned to different participants in order to successfully and collaboratively over-come a challenge and to obtain a desired result within the game hypothetical environment. For example, in some embodiments, a combination of different strengths, attributes, and characteristics of a plurality of different characters must be cooperatively applied to a particular situation in order to achieve a desired result within the game.

By requiring cooperation of different characters within the game and by carefully modeling a diverse set of game characters for the participants to select from, it is possible to encourage and promote social groupings of virtually any desired combination. Various profiling and psychological analysis can also be used to refine character descriptions and attributes so that the characters will closely correlate with the personalities and traits of disparate participants.

In some embodiments, the participants participate in hypothetical battles within the game environment, wherein the success of a particular attack or defensive action during a battle sequence is determined by a combination of the assigned strengths, weaknesses and attributes of the participants' character, the type of question asked and the participants' personal mastery of the educational materials.

In some embodiments, a participant's assigned character initiates an attack on another participant's character within the game environment by asking a question corresponding to particular educational material. The difficulty or mastery level associated with a question corresponds to a type of weapon or shield that is used in the game environment and the potential damage or success of the attack. The defender defends against or is shielded from the damage of an attack by answering the presented question correctly. Different metrics can be used to determine how accurately a question is answered and how much corresponding damage is suffered, if any.

Other actions and activities initiated by the participant or otherwise presented in the storyline, including level advancements and character development, also correspond to the successful mastery of educational materials, as evinced by correct answers to presented questions, and in some instance the successful presentation of questions.

The participant characters also encounter and use articles, tools and other items within the hypothetical game environment, each of which has its own unique and predetermined characteristics, attributes and capabilities. These items, as well as the currency that can be used to buy certain items, are obtained through mastery of the educational materials, as described above, by the successful presentation of questions and answers.

Inasmuch as the successful completion of a task, the acquisition of an item, the progress within a storyline and the development of a character directly correspond to the successful mastery of certain educational materials, corresponding reports and metric evaluations of a participant's knowledge and skill sets can similarly be obtained by directly evaluating the measured progress, development and possessions of the participant's storyline character(s).

In some embodiments, the educational materials are contextually unrelated to the storyline and game actions. In other embodiments, the educational materials are contextually related to a game action or storyline.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
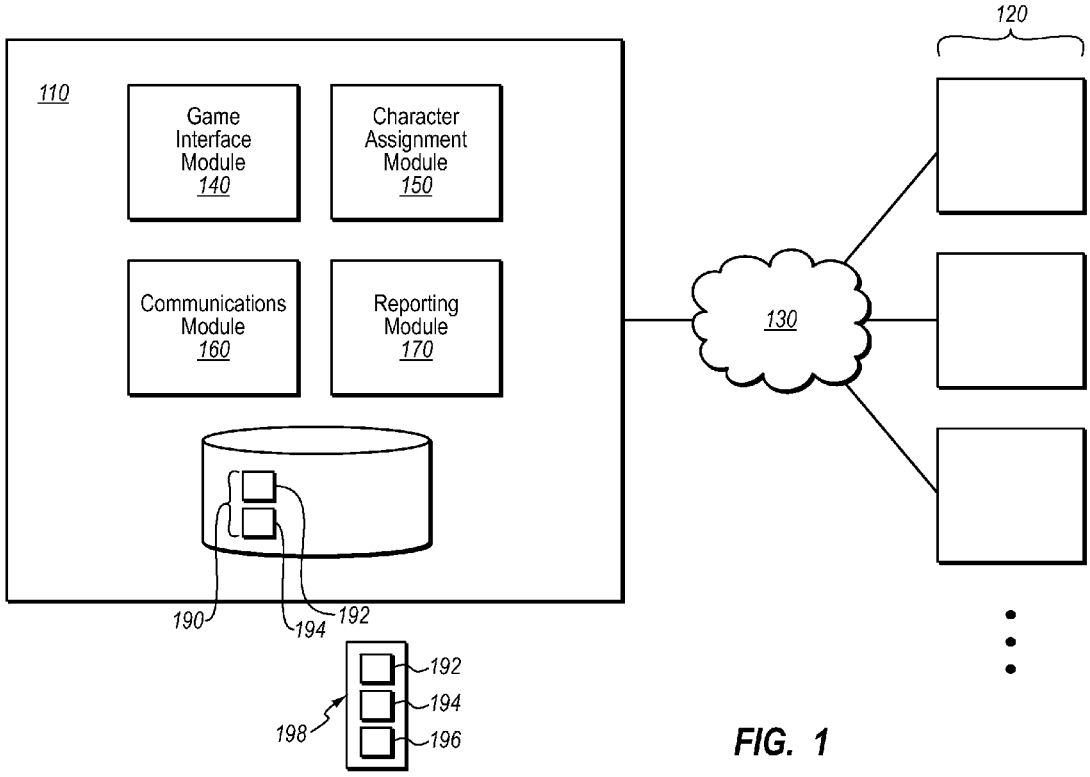
FIG. 1 illustrates a computing environment in which certain embodiments of the invention can be practiced.

The present invention relates to games, as well as methods, systems and computer-program products for providing and using the games to promote education and social development.

Although the use of computers are not necessary for every embodiment of the present invention, some embodiments of the present invention do comprise one or more computers, including various computer hardware, as discussed in greater detail below with regard to a client system and third party computing systems.

Certain embodiments within the scope of the present invention also include computer-readable media for carrying or having computer-executable instructions and data structures stored thereon. The computer-executable instructions can include computer interfaces, games, multimedia content and modules for implementing any part or the entirety of the different claimed embodiments.

As described herein, "computer-executable instructions" comprise instructions and data which cause a general purpose computer, special purpose computer, or special purpose processing device to perform a certain function or group of functions. Computer-executable instructions are also sometimes referred to herein as modules. Many of the computer-executable instructions are also embodied as applets, scripts and executables that can be transmitted between the computing systems described below.

The computer-readable media containing the computer-executable instructions or modules include any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer.

When information is transferred or provided over a network or another communications connection (either hardwired, wireless, or a combination of hardwired or wireless) to a computer, the computer properly views the connection as a computer-readable medium. Thus, any such connection is properly termed a computer-readable medium. Combinations of the above should also be included within the scope of computer-readable media.

To help facilitate a correct understanding and interpretation of the scope of the claims and application, certain additional terms will also be defined.

The term "attribute", as used in reference to character attributes, is defined as any combination of one or more characteristics of the game characters, including, but not limited to an attack attribute, a defense attribute, a skill level or encumbrance, a profile, a title, a resource, a power, a speed, an agility, a special knowledge, a character designation, a classification, hit points, status, energy, and any other identifiable characteristic.

The term "attack attribute" and "defense attribute" correspond specifically to attributes that affect an outcome of a battle sequence or action involving at least one game character.

The term "battle" generally corresponds to a game action in which a character receives an attack and/or initiates an attack that involves another character, game entity or object. A "battle" also typically includes, although not necessarily, a character defending against an attack. In many embodiments, an attack is performed by the presentation of a question to a game participant by another game participant or moderator associated with the attacking character, entity or object in the game environment.

The attack attributes, referenced above, generally correspond to combinations of weapons, spells, poisons, characteristics and other possessions associated with character in the game environment that can be used to inflict damage to another object, entity or character within the game environment. The defense attributes, on the other hand, generally correspond to combinations of shields, protective items, spells, characteristics and other possessions associated with a character in the game environment and that can be used to avoid, protect against or deflect an attack within the game environment.

The term "possessions" is generally used in reference to any combination of weapons, clothing, items, objects, currency, spells, food, and even other entities or characters that are controlled or possessed by a character within the game environment.

The term "game environment" generally refers to a fictitious environment in which the game participants' characters participate in game actions, progress through a storyline and interact with other characters, entities and objects. In some embodiments, the game environment is modeled after an environment that is familiar to the game participants. The game environment is sometimes only a conceptual or hypothetical environment described by a moderator or text. In other instances the game environment also includes physical models and objects, graphical displays, game boards, cards, dice, pictures and so forth. The game environment defines the setting in which the game participants' characters interact, progress and develop. In some instances, storylines are used to further define the game environment. The rules for the interactions, progressions and development of characters within the game environment are recited in any combination of printed text (e.g., books, manuals, charts, and so forth) and computer interfaces.

In some embodiments of the invention, the game environment and storyline are presented without the use of a computer. In other embodiments, a computer is used to present the game environment and storyline within an interactive computer game. Computers can also be used to perform profiling, assigning of characters to participants, and reporting of the participants' mastery of educational materials.

One suitable computing environment 100 for implementing aspects of the present invention will now be described with reference to FIG. 1.

Computing Environment

As shown in FIG. 1, the computing environment 100 includes a client system 110, and one or more remote systems 120, which can include any combination of other client systems, proxy servers, and server systems.

Although the term "server" and "client" can denote fixed relationship between computing systems in which the server provides services to the client, it will be appreciated that the present application does not require such a formal or fixed relationship. Instead, the terms 'server' and 'client' are used in this application for convenience of description, inasmuch as all of the computing systems referred to in this application can operate at disparate times as a traditional server as well as a traditional client.

It will also be appreciated that the client and the remote third party systems can include any combination of stand-alone computing systems, gaming consoles, and distributed systems having a plurality of individual computing systems that are connected through a communication link, such as communication link 130, which can include any combination of physical and wireless communication paths. In some embodiments, the communication link 130 includes at least the Internet.

Inasmuch as the client and the remote third party systems can each include any combination of stand-alone computing systems, gaming consoles, and distributed systems, the illustrated modules 140, 150, 160, 170 that are shown to be located within the client system can actually be distributed among any combination of stand-alone computing systems, gaming consoles, and distributed systems.

Each of these computing modules, including the game interface module 140, the character assignment interface 150, the communications module 160 and the reporting module 170 will now be described in more detail.

The game interface module 140 includes sufficient computer-executable instructions for presenting multimedia content, network interfaces, menus, text, and other content at a display associated with the client system 110 and corresponding to the game environment, the storyline, and character interactions. The game interface module 140 is also configured, in some instances, to present multimedia content to the user for review and in the form of a question presented in response to a game action.

In some instances, the game interface module 140 also includes computer-executable instructions for customizing or building a game environment and storyline. The game interface module 140 also includes sufficient computer-executable instructions for presenting interfaces that are configured for receiving answers to presented questions and other input from the user.

The character assignment module 150 includes sufficient computer-executable instructions for presenting a plurality of characters to the user and for assigning one or more of the characters to the user. In some instances, the assignment is based on a user selection and a user affinity for a character. In other instances, the assignment is controlled by matching a profile of the user with a profile of the characters. In these instances, the character assignment module 150 also includes sufficient computer-executable instructions for profiling the user and matching the profile of the user, or at least one attribute of the user, to the profile of a character, or at least one attribute of a character.

The character assignment module 150 also includes sufficient computer-executable instructions for developing and customizing characters and their attributes.

The communications module 160 includes sufficient computer-executable instructions for coordinating communications between the various modules 140, 150, 160, 170 and between the client system 110 and the one or more remote systems 120. The communications module 160 includes sufficient computer-executable instructions for presenting information generated by the various modules (140, 150, 160 and 170) to a user through one or more user interfaces.

The reporting module 170 includes sufficient computer-executable instructions for evaluating and assessing a user's mastery of educational materials and for generating a grade or score corresponding to the user's mastery of the educational materials. In some instances, the reporting module 170 assesses a user's mastery of educational materials based on a predetermined combination of the progress, possessions, rewards, and other attributes of the user's character within the game environment. This is possible, inasmuch as the progress, possessions, rewards and attributes of a character within the game environment is dependent upon a user's answers to questions about the educational materials.

FIG. 1 also illustrates that the client 110 can include storage 180 for storing the computer-executable instructions that enable the computing functionality implemented by the client as well as the content 190 used by the client 110. Some of the content 190 maintained or utilized by the client includes rules 192 regarding participation in a game and rules for assigning characters. The data can also include character files 194 that describe the characters, their attributes, their status, and any other corresponding multimedia files corresponding to the characters. Other data corresponding to the game environment and storylines can also be stored by the client.

It will be appreciated that the client storage 118 can include any combination of volatile and non-volatile memory which is stored locally at the client system or that is remotely located from the client system 110, such as, for example, at a remote system 120, or on disk.

It will also be appreciated that the remote systems 120 can include any combination of the modules 140, 150, 160 and 170 contained by the client 110, including the game interface module 140, the character assignment module 150, the communications module 160 and the reporting module 170.

Game Play

Figure 2:
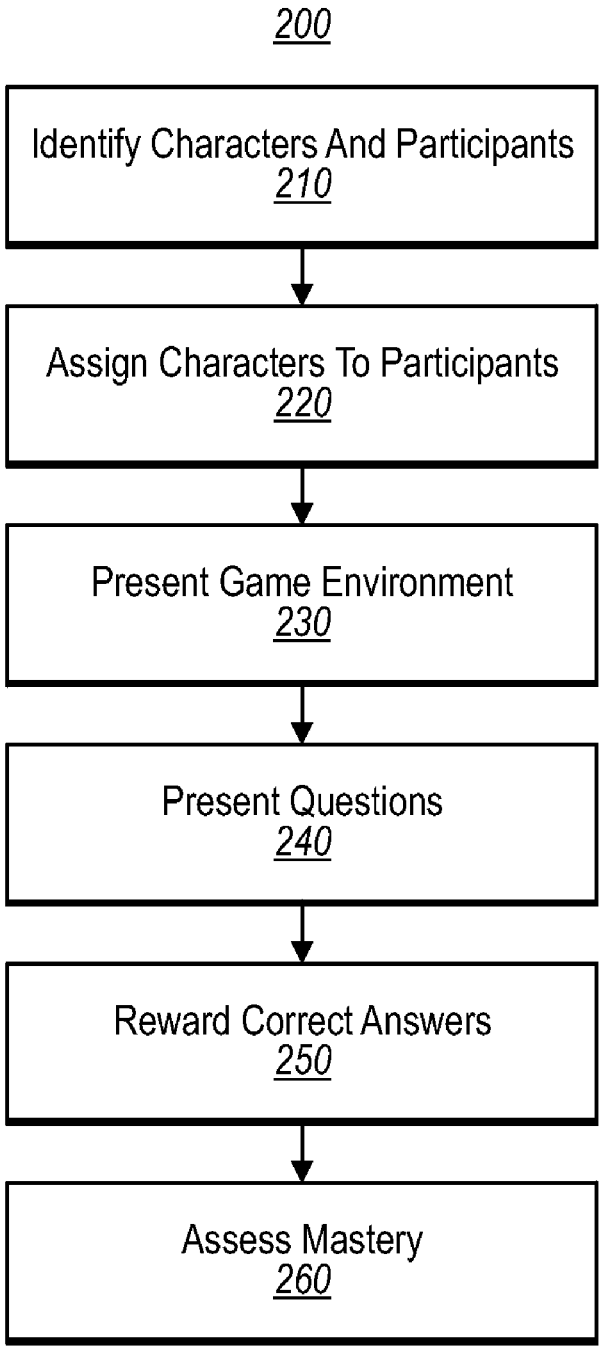
FIG. 2 illustrates a flowchart of acts that are executed during certain embodiments of the invention.

Attention will now be directed to FIG. 2 which illustrates a flowchart containing various acts can be implemented by any combination of human moderators, game participants, client systems 110 and remote systems 120 to practice aspects of the claimed embodiments.

The first illustrated act corresponds to the identification of characters and participants for a game (act 210). The characters for the game and their corresponding attributes can be identified (act 210) in various ways. In some instances, the characters and their attributes are predefined and unalterable. In other embodiments, the game participants and/or moderators help to create or define the characters and their attributes.

Once the characters are defined, they are presented to the user through any desired combination of computer interfaces, textual descriptions and oral descriptions. In some instances, for example, the game participants are presented with a chart, cards, text or materials that define different characters and their attributes. Two dimensional images and three dimensional objects can also be associated with the characters and referenced by the participants in the assignment process. Images and models of the characters are is particularly useful in embodiments in which the game environment is presented on a computer interface or a physical game board.

In some embodiments, the characters are categorized based on type, species, classification, mastery level, or other category. One non-limiting example of identifying and presenting characters will now be provided in which characters are categorized by choice and class. A Character Choice Table, Table 1, is first provided to illustrate some non-limiting examples of character choices that correspond to species. A Character Class Table, Table II, will also be provided to illustrate some non-limiting examples of character classes that correspond to professions or roles.

TABLE I (CHARACTER CHOICE TABLE):

| Character Choice | Character Choice Description |
|---|---|
| WOLF | The wolf is a stealthy species, quiet, calculating, and wise. The wolf tends to run in packs only because he is intelligent enough to realize the benefits of pack hunting. The wolf can also operate as an individual adequately enough, and does so when it is in his best interest. |
| CROW | The crow is also an intelligent species, primarily interested in its own profit. They often prey on others, although some crows have been known to develop differently than their kind, becoming selfless rather than vulturous, choosing to help rather than prey. The crow is a fierce but patient hunter. |
| CHAMELEON | The chameleon is a sly, clever species, capable of changing shape and color to imitate his surroundings. The chameleon rarely chooses outright confrontation, preferring subtlety to aggression. It is a mistake, however, to underestimate the power of the chameleon. |
| DRAGON | The dragon is the boldest of all species, renowned for his ferocity and battle prowess. His sheer strength and size make him a force to be reckoned with. Little can withstand the will of a dragon. |

TABLE II (CHARACTER CLASS TABLE):

| Character Class | Character Class Description |
|---|---|
| Shaman | A Shaman is a healer, interested in the welfare of others, and a very valuable member for any army due to his/her healing powers. A Shaman can heal wounded during battles with the use of medicaments purchased from the PX. Only Level 4 Shamans can revive a fully dead individual with the appropriate card, again purchased from PX. To attain status as a Shaman, a student should pursue citizenship and community related activities. Status points must be negotiated and contracted with the teacher. A Level 1 Shaman can only function in the capacity of Warrior, but through |

TABLE II-continued (CHARACTER CLASS TABLE):

| Character Class | Character Class Description |
|---|---|
| | training and experience, can slowly advance from Level to Level and learn the skills to heal wounds inflicted by Archers, non-fatal wounds inflicted in close combat, and eventually, revive fully dead comrades. Because Shamans are primarily interested in the well being of others, they can also negotiate treaties, achieve neutrality, etc. Wolves and Crows are most likely to become Shamans. |
| Merlin | A Merlin is akin to a wizard and is skilled in the use of magic and illusion. Only Merlins can use spells purchased from the PX, and only in a manner consistent with their current Level. To achieve Merlin status, students must research on related fields in English and History, analyze relevant mythologies, and assist in the construction of a classroom mythology. Merlins are valuable members of any army and are equally likely to emerge from every character species, although, as an innately magical species, Dragons will often attain Merlin distinction. |
| Shadow | The Shadow class is one of the most secretive sects. They are incredible fighters, especially in close quarters and capable of administering lethal, stealthy hits on marked targets outside of Battle. To access this elusive group, students must rigorously train their minds and bodies through intense study and discipline. Only the purest of purpose can advance to Level 4 status. Students can achieve status as a Shadow through research on related/relevant academic studies into historical precedent, current events, etc. Lower level Shadows can only target smaller, perceivably vulnerable targets and earn experience via battle opportunity and number of successful solitary "hits." They cannot "mark" commanders of armies with 3 or more until they have earned Level 3 or 4 status. Wolves and Chameleons make great Shadows. |
| Monk | A Monk studies religion and philosophy, and, although automatically equipped with default Warrior status, would rather ponder and write than fight. Monks are typically the scribes of any group, and are possessed with secret knowledge and truth. Monks are intimately involved in the construction and interpretation of mythologies. Wolves and reformed Crows make great Monks. |
| Archer | The Archer is a highly useful class in battle. Archers are able to purchase Longbows and Arrows for use in inflicting premature damage on an opposing army. Training for Archer status requires "long-shot" projects targeting ideas, concepts, and people beyond the classroom walls. Because of its usefulness and relative ease in acquisition, many characters will achieve Archer status in addition to other class distinctions. An Archer's number of Arrow questions fired will be based on level, and the Archer can only be combated by other Archers, specialized Merlin spells, focused Rasputin operations, and the healing powers of Shamans. Lower level Archers can only injure and not kill, making the Shaman a desired defense. |
| Rasputin | A Rasputin is a specialized class skilled in subterfuge. Characters pursuing Rasputin status would be required to do extensive research on the historical importance of such figures as well as plan and execute incendiary operations as negotiated with the teacher. The value of the Rasputin would be in covert ops such as espionage, orchestrating strategic dysfunction, accessorial looting, etc. All character species can attain this class, although Chameleons seem to be the most adept. |
| Jester | A Jester is a highly sought after commodity because of his or her ability to entertain. Skilled Jesters know the difference between what is funny and what is not. The Jester class is comprised of serious students of comic relief who make their laughs an academic study. The Jester has no special weapon for battle and must rely on his or her default Warrior status. |
| Warrior | Although a default class, the Warrior is a reputable figure. The Warrior knows how to get things done efficiently and is essential to every army. Warriors will often accumulate immense wealth and prestige. Dragon Warriors are fierce to behold! |

It will be appreciated that the foregoing examples of characters and character types are non-limiting. In particular, there are various types of characters and attributes that can be described beyond those shown above. Images and objects associated with the physical appearance of the characters can also be included in any description and presentation of the characters.

Furthermore, although the foregoing example is directed to a fantasy genre, characters can also be provided for other genres, including modern and real genres corresponding to sports, education, work, city life, children, nature and so forth.

The identification of characters (act 210) can also include the identification of their attributes, including character attack attributes and defense attributes. The identification of attack and defense attributes can be helpful in enabling a participant to select a character based on a perceived benefit to a group that includes the character or that provides a perceived advantage in obtaining a desired result within the game environment.

The following table, Table III, provides one non-limiting example of attack attributes and defense attributes that are generally described and associated with different types of characters. In this example, different attributes are associated with different levels for each character.

TABLE III (CHARACTER ATTACK AND DEFENSE ATTRIBUTE TABLE):

| Character Class | Level 1 | Level 2 | Level 3 | Level 4 |
|---|---|---|---|---|
| Shaman | Healer in training. No substantial skills in healing. Default Level 1 Warrior status | Healing powers limited to injuries inflicted by Level 2 Archers and minor injuries incurred in battle situations | Can heal all non-fatal injuries inflicted in battle situations. | Advanced healer capable of healing all types of injuries, including, at times, even death. Optional neutral status. |
| Merlin | Wizard in training. Extremely limited abilities, Level 1 spells. Default Level 1 Warrior status. | Limited abilities in battle. Can use Levels 1-2 spells. | Skilled in the use of spells for attack and defense, Levels 1-3 | Highly skilled in the use of spells for attack and defense, Levels 1-4, purchasable in the PX. |
| Shadow | Focused on learning discipline and mental acuteness. Default Level 1 Warrior status. | Participate in secret practice sessions with a Master to learn the Shadow arts | Field training of secret Shadow arts. | Master of Shadow arts. Extremely effective in close combat scenarios with specialized attacks and defense. Excellent asset to any army. |
| Monk | Student of religion/ philosophy. Novice in ability to discern truth. Scribe - taker of notes. Default Warrior status | Scribe. Continue studies in philosophy and mythology. Work on constructing classroom mythology. Default Warrior status. | Scribe. Knowledgeable in studies. Advanced construction of classroom mythology. Default Warrior status. | Extremely knowledgeable in mythologies, belief systems, legend, lore, and artifacts. Useful in the search of hidden meanings/ knowledge. Default Warrior status. |
| Archer | Specialized Class. Begin training by taking on "long-shot" assignments outside of class/school. Default Warrior status. Purchase Longbow. | Level 2 Archer continues with "long-shot" tasks. Archery practice for battle. Limited to single shot per battle. | Accurate marksman. Can injure but not kill enemies from distance. Limited to two shots per battle. | Highly accurate marksman, potent in battle. Can deal death blows to foe from distance. No limit to shots fired. |
| Rasputin | First Level training begins with academic research into villainous characters from history. Default Warrior status. | Continue research. Begin drafting own plans. Train by planning and initiating small scale operations. Field practice. | Can infiltrate other groups. Spy, subvert order, orchestrate mutinies, etc if skillful enough. Additional looting rights up to $20. | Highly advanced in subterfuge including additional looting rights up to $50 with valid card purchased from the PX. |
| Warrior | Basic attack and defense skills. Only little wealth to purchase goods. Default status for all other | Accumulating more wealth for purchase of weaponry in PX. | Position of responsibility and power. Substantial wealth and influence. Well equipped with | Master of weaponry. Wealthy and powerful fighter. Often the commander of armies. Can |

TABLE III-continued (CHARACTER ATTACK AND DEFENSE ATTRIBUTE TABLE):

| Character Class | Level 1 | Level 2 | Level 3 | Level 4 |
|---|---|---|---|---|
| | classes in training. | | armor and weaponry. Can take P.O.W.'s if in command. | take P.O.W.'s if in command. |

The following table, Table IV, provides another non-limiting example of attack attributes and defense attributes that are associated with different types of characters. In this following example, specific weapons and other items associated with different characters help to define the attack and defense attributes of those characters. In this example, different attack weapons (O) and defensive weapons (D) are available for different characters based on the skill levels or encumbrances (E) of the different characters.

In order for a character within the game environment to purchase or use any of the recited items, the game participant may be required to ask or answer a question correctly, as defined in more detail below.

As shown in Table III, there are different types of questions that correspond to the different items and character attributes.

TABLE IV (CHARACTER ATTACK AND DEFENSE ATTRIBUTE TABLE):

| FIGHTER | Knight | Martial Artist | Commando |
|---|---|---|---|
| Level One - True/False Question-E2 | | | |
| Offense E-1 | O-1 Blunted Sword | O-1 Jab | O-1 B—B Gun |
| Defense E-1 | D-1 Tunic | D-1 White Belt | D-1 Headband |
| Level 2 - Multiple Choice Question-E4 | | | |
| Offense E-2 | O-2 Short Sword | O-3 Kick | O-4 Hand Gun |
| Defense E-2 | D-4 Chain Mail | D-3 Orange Belt | D-2 Camouflage |
| Level 3 - Fill-in-the-blank Question-E6 | | | |
| Offense E-3 | O-3 Long Sword | O-5 Grapple | O-7 Rifle |
| Defense E-3 | D-7 Chest Plate | D-5 Brown Belt | D-3 Combat Vest |
| Level 4 - Performance Question-E8 | | | |
| Offense E-4 | O-4 Great Sword | O-7 Num Chuck | O-10 Bazooka |
| Defense E-4 | D-10 Full Plate | D-7 Black Belt | D-4 Kevlar Combo |
| **ARCANE CASTERS** | **Elementalist** | **Treewalker** | **Merlin** |
| Level One - True/False Question-E2 | | | |
| Offense E-1 | O-1 Wand | O-1 Twig | O-1 Wand |
| Spell | Singe | Mosquito | Singe |
| Defense E-1 | D-1 Robe | D-1 Robe | D-1 Robe |

TABLE IV-continued (CHARACTER ATTACK AND DEFENSE ATTRIBUTE TABLE):

| | | | |
|---|---|---|---|
| Spell | Puddle | Leaf Skin | Puddle |
| Level 2 - Multiple Choice Question-E4 | | | |
| Offense E-2 | O-2 Staff | O-3 Staff | O-4 Staff |
| Spell | Sunburn | Snake | Kindle |
| Defense E-2 | D-4 Snowman | D-3 Tree skin | D-2 Snow |
| Level 3 - Fill-in-the-blank Question-E6 | | | |
| Offense E-3 | O-3 Orb | O-5 Stone | O-7 Orb |
| Spell | Torch | Wolverine | Fireball |
| Defense E-3 | D-7 Igloo | D-5 Stone skin | D-3 Ice |
| Level 4 - Performance Question-E8 | | | |
| Offense E-4 | O-4 Orb Staff | O-7 Stone Staff | O-10 Orb Staff |
| Spell | Kindle | Bear | Inferno |
| Defense E-4 | D-10 Moat | D-7 Nature Skin | D-4 Snowman |
| **HEALER** | **Medic** | **Inquisitor** | **Shaman** |
| Level One - True/False Question-E2 | | | |
| Offense E-1 | O-1 B—B gun | O-1 Headache | O-1 Rash |
| Defense E-1 | D-1 Bandaid | D-1 Robe | D-1 Tea |
| Level 2 - Multiple Choice Question-E4 | | | |
| Offense E-2 | O-2 Tranquilizer Gun | O-3 Migraine | O-4 Cold |
| Defense E-2 | D-4 Salve | D-3 Cowl | D-2 Tincture |
| Level 3 - Fill-in-the blank Question-E6 | | | |
| Offense E-3 | O-3 Hand Gun | O-5 Delusion | O-7 Flu |
| Defense E-3 | D-7 Gauze Strip | D-5 Chainmail | D-3 Vial (Health) |
| Level 4 - Performance Question-E8 | | | |
| Offense E-4 | O-4 Rifle | O-7 Breakdown | O-10 Pox |
| Defense E-4 | D-10 First-Aid Kit | D-7 Shield-Chainmail | D-4 Potion (Health) |

TABLE IV-continued (CHARACTER ATTACK AND DEFENSE ATTRIBUTE TABLE):

| STEALTH | Rasputin | Ranger | Shadow |
|---|---|---|---|
| Level One - True/False Question-E2 | | | |
| Offense E-1 | O-1 Wrist Rocket | O-1 Wrist Rocket | O-1 Wrist Rocket |
| Defense E-1 | D-1 Tunic | D-1 Tunic | D-1 Tunic |
| Level 2 - Multiple Choice Question-E4 | | | |
| Offense E-2 | O-2 Throwing Cards | O-3 Short Bow | O-4 Dagger |
| Defense E-2 | D-4 Mask | D-3 Cowl | D-2 Camo |
| Level 3 - Fill-in-the-blank Question-E6 | | | |
| Offense E-3 | O-3 Darts | O-5 Long Bow | O-7 Sniper Rifle |
| Defense E-3 | D-7 Cloak | D-5 Boots | D-3 Cowl |
| Level 4 - Performance Question-E8 | | | |
| Offense E-4 | O-4 Dagger | O-7 Crossbow | O-10 Poison |
| Defense E-4 | D-10 Impersonation-Rats | D-7 Cloak | D-4 Mask |

Notwithstanding the specificity of the foregoing examples, it will be appreciated that there are many other formats for identifying and defining characters, along with their unique attributes, including printed manuals, cards, pamphlets, and other materials, computer displays, oral descriptions and so forth.

As mentioned above, each game participant is assigned one or more characters (act 220). Any suitable means can be used for assigning the characters to the participants, including, but not limited to any combination of moderator instructions, default rules, profile, by affinity, by random selection (as determined by the roll of a dice, selection of a card, etc.), and so forth. One example of a means for assigning characters is the use of profiling surveys and questionnaires to identify and map participant profiles/attributes to character profiles/attributes.

The assignment of characters based on profile matching and/or a participant's affinity for a character can be particularly beneficial for encouraging social groupings and interactions between participants having disparate personality types and demographic backgrounds. Careful mapping and modeling of character attributes to different personality types can also encourage diverse social groupings and participant interactions as the participants' characters are forced to interact within the game environment.

As mentioned above, the selection and assignment of characters (act 220) can be based at least in part on profiling and questionnaires. Some of the questions that can be asked of the participant, for example, can include questions corresponding to self-described personality traits, likes, dislikes, demographic information, and so forth. The following table, Table V, illustrates one non-limiting example of a profiling survey. In this survey, participants are asked to select every entry that describes the participant.

TABLE V (PROFILING SURVEY TABLE):

| X | SELECT ALL THAT APPLY WITH AN X |
|---|---|
| | Sits in the front of class |
| | Sits in the back of class |
| | Student of history |
| | The past is the past |
| | Gets good grades |
| | Has difficulty doing homework |
| | Plays with people's minds/emotions |
| | Enjoys riddles, puzzles |
| | Leader of the pack |
| | Would rather follow |

It will be appreciated that the analysis and matching of profiles between the participants and characters can occur automatically in response to profiling input entered into a computer as well as manually, in response to examining profiling data. Matching of profiles can also be based on participant and moderator discretion.

After or before the characters are assigned, the game participants are introduced to the game environment (act 230). The game environment, as described above, can include any of the storylines, character interactions, and resources corresponding to the characters, entities and other objects and items referenced in the game. In some instances, the game environment is merely conceptual. In other instances, the game environment includes at least some images, text or three dimensional models that can be viewed and referenced.

In some embodiments, the game environment is generated and displayed by computer software running on one or more computing systems, such as, for example, the client system 110 or remote systems 120 described above in FIG. 1.

The game environment may also include rules 192, character materials 194 (e.g., images, descriptions, models, cards, and so forth), as well as any other game materials 196, such as a game board, dice, spinner, map, storyline descriptions, moderator instructions, illustrations, cards, as well as any physical means for assigning the characters to the game participants (e.g., character descriptions, rules, guidelines, surveys, questionnaires, dice, spinners, etc.), and so forth.

As the game is played, each participant's character will participate in various game activities including one or more game actions. It will be appreciated that virtually any type of action or activity can be encountered within the game environment, as defined by the rules and guidelines of the game or as dictated by a game moderator.

Some non-limiting examples of actions or activities that can involve a character within the game environment include (a) developing a code of conduct and a personal coat of arms, (b) swearing an oath of honor and virtue, (c) initiate quests, (d) encounter and defeat a foe, (e) assist another in distress, (f) join a group or army, (g) lead a group or army in battle, (h) purchase items of value, (i) develop skill, (o) advance a character level, (p) modify a character attribute, (q), obtain a possession, (r) interact with another character, (s) design and initiate feats, and so forth. In fact, virtually any contemplated activity or action can be incorporated into the game environment and storyline.

One reoccurring activity within some embodiments is battle, where the participant's character battles with one or more other characters and entities. The battle can be voluntarily, such as when the character initiates the battle or attack, or involuntary, such as when the character is attacked.

A battle consists of sequences in which each character or group of characters in the battle take turns delivering blows to the opponent(s) in the form of a question and then conducting a strategic defense to a received blow by answering a question posed by the opponent(s). Victory in battle is determined when one character or team sufficiently damages or destroys their opponent(s). The damage of each attack during a battle is based on a predetermined combination of the battling characters' attributes, including attack and defense attributes, the type of question presented with the attack (act 240) and the answer given in response to the question (act 250).

To successfully deflect or shield against the damage of an attack, the defender must provide a correct answer to the question. Different levels of accuracy and quality in the answer can be considered and affect the application of damage to a character or group.

In some embodiments, the questions asked of a participant during battle or during another game action correspond to educational materials that are contextually unrelated to the game environment, game action, or game storyline. In other embodiments, the presented questions are contextually related to the game environment or a game action. Such embodiments may include, for example embodiments in which game environments and game actions that are modeled after particular training duties and training materials and that have been incorporated into the game environment. It will also be appreciated that combinations of contextually related and unrelated questions corresponding to a plurality of different subjects can be presented to accommodate virtually any need and preference.

In some embodiments, government mandated tests are presented to the game participants as they battle or interact with other characters and entities within the game environment. For example, a 'big boss' or quest may correspond to a school or state mandated test. The participant will be asked questions from the mandated test as the participant's character progresses through the quest or battles the 'big boss'. The successful completion of the test, as determined by satisfying predetermined standards, will result in a commensurate reward within the game environment.

Notwithstanding the foregoing description of battles, it will be appreciated that battles and combat actions are not required in all embodiments of the present invention to successfully present and test educational materials. In fact, for participants and users that do not want to engage in hypothetical actions that resembles a violent action, game environments can be created that replace combat and battle actions with non-violent actions, such as obtaining possessions, performing a feat, and so forth.

The rewards for correctly answering questions (act 250) can also include rewards other than victory in battle. For example, a character within the game environment can obtain other rewards for correctly answering questions too, including a possession, a character attribute, the successful completion of a task or level, money, food, or any other reward.

Although rewards are typically good, a reward can also include a negative consequence to a game action when the participant fails to answer a question correctly.

The foregoing examples have been provided with specific regard to the presentation of questions and answers. It will be appreciated, however, that particular behavior of a participant can also result in the application of a reward to the participant's character within the game environment. For example, a student's attendance or completion of a project or assignment can also result in the application of an award to the student's character within the game environment. Similarly, an absence, a tardy, bad behavior and other performances can also result in the application of a negative reward or consequence for the student's character.

According to some embodiments of the invention, a participant's mastery of the educational materials presented during a game can be assessed by evaluating a status or condition of the participant's character within the game environment. (act 260).

In particular, as a participant plays the game and answers questions about the educational materials that are presented, the participant's character will advance through a storyline, interact with other entities and objects, and develop character's attributes. The participant's mastery of the educational materials can therefore be assessed by evaluating and measuring the success and failures of the participant's character within the storyline. A character's developed attributes, skill levels, titles, possessions and progress though a storyline can also be measured and used to identify a grade or score corresponding to the participant's mastery of the educational materials.

Using games of the invention to present and test educational materials that correspond to a school curriculum can be particularly beneficial when the students do not necessarily care about their academic grades and when the students have a difficult time interacting with others. In particular, a student's interest in playing interactive games, developing game characters and engaging in hypothetical battles within a game environment can be used as a motivator for the students to study and learn desired content. The methods and systems of the present invention can also help encourage social interaction of diverse groups of students as the students' characters interact within the game environment.

In some embodiments, the methods of the invention also include requiring a participant with one type of character to recruit other participants with other types of characters to develop a well-rounded or diverse group that is capable of accomplishing tasks encountered during game play. Group diversification can also be beneficial during battle, inasmuch as different attributes of different group members can be leveraged to provide flexibility in the attacks and maneuvers during a battle.

Embodiments requiring recruiting of group members are also particularly beneficial for building the self-esteem and confidence of socially challenged participants as they feel valued, during the recruiting process, and when they are able to make contributions to the group during game play.

In summary, the application and testing of educational materials with games, according to the present invention, can promote a heightened interest and attention in learning and can help remove some of the social barriers created by cliques. The present invention can also enable game participants to leverage and utilize their special knowledge of playing other games, particularly other role-playing type games.

The present invention is also particularly beneficial for motivating students to learn additional materials, beyond the minimum requirements mandated by the government, as the students will want to obtain a strategic advantage within the game environment.

The game environment can also be customized and modified at any time to accommodate virtually any curriculum and educational materials, including, but not limited to mathematics, English or other languages, social studies, history, geography, geology, physics, physical education, job specific materials, school curriculum, and so forth. In this regard, the present invention will be particularly useful in schools applying the new learning theories regarding Individual Education Planning (IEP), wherein the students have the opportunity to learn at their own pace.

Although the foregoing embodiments have been described in language specific to structural features and/or methodological acts, it is to be understood that the subject matter defined in the appended claims is not necessarily limited to the specific features or acts described above, or any particular order for implementing the recited acts. Rather, the specific features and acts described above are disclosed as only examples for some of the claimed embodiments.

In particular, although many of the foregoing examples refer to embodiments for participating in a game that is played with the use of a computing system, the inventive games and methods for playing the games do not necessarily require computers. In some embodiments, for example, the game is a board game in which the players have characters advance around or through portions of the game board. In these embodiments, it will be appreciated that the instruction manuals, rules, cards, pictures, game environment models, character models, charts, dice, spinners and other game board tools all comprise suitable means for implementing the acts described above, including the acts recited in reference to FIG. 2. These game tools also comprise components of the game environment when the game is a board game.

Accordingly, although specific examples have been provided with regard to the embodiments described above, the present invention may be embodied in other specific forms without departing from its spirit or essential characteristics. Accordingly, the described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for presenting and testing educational materials within a computer game environment in which multiple human participants play the role of assigned virtual game characters that engage in battle sequences within the game environment and wherein the success of battle attacks and defensive actions involving the assigned characters during the battle sequences within the game environment are determined by a combination of assigned strengths, weaknesses and attributes of the assigned virtual game characters, as well as types of questions asked and the answers given by the multiple human participants that reflect personal mastery of the educational materials, the method comprising:

identifying a plurality of virtual game characters, corresponding to a virtual game environment, that are stored on a computing system and that each comprise a corresponding and unique set of game attributes that include at least an attack attribute and a defense attribute for participating in a battle sequence involving at least two virtual game characters within the virtual game environment;

assigning a first virtual game character to a first human participant from a pool of available virtual game characters;

assigning a second virtual game character to a second human participant from the pool of available virtual game characters;

presenting the virtual game environment on the computing system with the first virtual game character in a storyline and that includes game actions that the first virtual game character participates in, and wherein the game actions include at least one of modifying the unique set of attributes that correspond to the first virtual game character, obtaining possessions for the first virtual game character, and/or using the first virtual game character to interact with a second virtual game character that is assigned to a second human participant;

identifying rules that define battle between the first and second virtual game characters, wherein said rules define types of questions that can be asked by the first and second human participants to initiate an attack with one or more virtual weapons wielded by the first and second virtual game characters during the battle within the virtual game environment and a potential for inflicting battle damage during the attack with the one or more virtual weapons, wherein battle damage comprises a reduction of one or more character attributes, and wherein the types of questions that can be asked and the potential for damage is based at least in part on the defined attack and defense attributes of the first and second virtual game characters;

presenting questions to the first human participant through the virtual game environment when the first virtual game character participates in particular game actions within the virtual game environment, wherein at least some of the presented questions are educational questions, which correspond to educational materials, and that are provided at least in part by the second human participant submitting one or more particular questions, wherein the one or more particular questions that can be submitted by the second human participant are limited to the attack attribute of the second virtual game character and are at least restricted to less than all questions that are available to be asked during battle by all of the available virtual game characters, and wherein said educational questions also correspond to one or more virtual battle attacks that are preformed with a virtual weapon and that are directed to the first virtual game character within the virtual game environment and that originate from the second virtual game character assigned to the second human participant, and wherein the first human participant defends the first virtual game character from the one or more attacks by answering said educational questions correctly;

rewarding the first virtual game character with a positive outcome to the particular game action within the virtual game environment for correct answers received from the first human participant in a response to the presented questions, including at least successfully defending the first virtual game character from suffering battle damage resulting from the one or more attacks by the virtual weapon within the virtual game environment, and wherein the battle damage comprises a reduction of at least one character attribute of at least the first or second character in the virtual game environment; and assessing mastery of the educational materials by the first human participant, wherein assessing mastery of the educational materials is based on an evaluation of rewards received by the first virtual game character within the virtual game environment and by evaluating progress of the first virtual game character within the game, which includes an evaluation of whether the one or more attacks are successfully defended.

2. A method as recited in claim 1, wherein the questions presented to the first human participant are contextually unrelated to the storyline involving the first virtual game character and the particular game action.

3. A method as recited in claim 1, further comprising:

Requiring the first virtual game character to join a group of at least one other virtual game character, and wherein rewarding the first virtual game character with a positive outcome to the particular game action is further dependent upon at least one other human participant associated with one of the at least one other virtual game character in the group providing a correct answer to a question.

4. A method as recited in claim 1, wherein each of the plurality of virtual game characters is associated with a personality profile.

5. A method as recited in claim 1, wherein assigning a first virtual game character to the first human participant includes the first human participant selecting the first virtual game character based on an affinity for the first virtual game character.

6. A method as recited in claim 5, wherein the first human participant selects the first virtual game character by completing a questionnaire that reflects an association between the first human participant and the first virtual game character.

7. A method as recited in claim 1, wherein the game action includes the first virtual game character participating in a battle with at least one other virtual game character, by attacking said other virtual game character through the presentation of a question asked by the first human participant to another human participant associated with said other virtual game character and that corresponds to the educational materials, and wherein potential damage of the attack is based on attributes of the first virtual game character, attributes of said other virtual game character and a type of question asked by the first human participant about the educational materials.

8. A method as recited in claim 1, wherein the virtual game environment is modeled after a school the first human participant attends, and wherein the method further includes modeling the virtual game environment after the school.

9. A method as recited in claim 1, wherein the educational materials comprise educational materials corresponding to a school curriculum.

10. A method as recited in claim 1, wherein the virtual game environment includes a game board and wherein rewarding the character includes moving the character on the game board.

11. The method of claim 1, further comprising:

determining a level of correctness of the first human participant's answer such that the amount of damage that the first virtual game character receives for an incorrect answer is proportional to the level of correctness of the answer.

12. The method of claim 1, wherein the reduction of the at least one character attribute comprises a reduction of one or more of an attack attribute, a defense attribute, a skill level, a profile, a title, a power, a speed, an agility, a special knowledge, a character designation, hit points, or an energy level.

13. The method of claim 12, wherein the reduction of the at least one character attribute comprises a reduction in hit points.

14. The method of claim 1, wherein the virtual weapon within the virtual game environment comprises one or more of a sword, a gun, a spell, a bow, a staff, a dagger, a grapple, a wand, a martial artist weapon, a knight weapon or a commando weapon.

15. A computer program product for use in a computing system that includes a processor that is capable of executing computer-executable instructions, the computer program product comprising:

One or more computer storage media having computer-executable instructions which implement a method for presenting and testing educational materials within a computer game environment in which multiple human participants play the role of assigned virtual game characters that engage in battle sequences within the game environment and wherein the success of battle attacks and defensive actions involving the assigned virtual game characters during the battle sequences within the game environment are determined by a combination of assigned strengths, weaknesses and attributes of the assigned characters, as well as types of questions asked and the answers given by the multiple human participants that reflect personal mastery of the educational materials, wherein the method is implemented when the computer-executable instructions are executed by the processor of the computing system, and wherein the method includes:

presenting, to a first human participant, a plurality of virtual game characters that each comprise a corresponding and unique set of attributes that include at least an attack attribute and a defense attribute;

assigning a first virtual game character to the first human participant from a pool of available virtual game characters;

presenting the virtual game environment on the computing system with the first virtual game character in a storyline and that includes game actions that the first virtual game character participates in;

receiving input from the first human participant that causes the first virtual game character to participate in a game action within the virtual game environment that includes at least one of modifying the unique set of attributes that correspond to the first virtual game character, obtaining possessions for the first virtual game character and using the first virtual game character to interact with a second virtual game character that is assigned to a second human participant;

identifying rules that define battle between the first and second virtual game characters, wherein said rules define types of questions that can be asked by the first and second human participants to initiate an attack with one or more virtual weapons during the battle and a potential for inflicting battle damage during the attack with the one or more virtual weapons, wherein battle damage comprises a reduction of character attributes wherein the types of questions that can be asked and the potential for damage is based at least in part on the defined attack and defense attributes of the first and second virtual game characters; and presenting a question to the first human participant through the virtual game environment in response to the input that causes the first virtual game character to participate in the game action, wherein the presented question comprises a question corresponding to educational materials that are unrelated to the storyline and game action, and wherein the presented question is provided at least in part by the second human participant submitting one or more particular questions, wherein the one or more particular questions that can be submitted by the second human participant is limited to the attack attribute of the second human participant and a corresponding virtual weapon wielded by the second virtual game character, and are at least restricted to less than all questions that are available to be asked during battle by all of the available virtual game characters and wherein the presented question corresponds to an attack within the virtual game environment with the corresponding virtual weapon wielded by the second virtual game character against the first virtual game character, such that upon the first human participant answering the question incorrectly, the first virtual game character suffers battle damage from the attack inflicted by the virtual weapon by the second virtual game character within the virtual game environment, wherein battle damage comprises a reduction of at least one character attribute selected from the group consisting of an attack attribute, a defense attribute, a skill level, a profile, a title, a power, a speed, an agility, a special knowledge, a character designation, hit points, or an energy level.

16. A computer program product as recited in claim 15, wherein the input received from the first human participant is received at the computing system through a network connection from a remote computing system where the input is entered.

17. A computer program product as recited in claim 16, wherein the network connection includes the Internet.

18. A computer program product as recited in claim 15, wherein the method further includes rewarding the first virtual game character with a positive outcome to the game action within the virtual game environment for correct answers received from the first human participant in response to the presented question.

19. A computer program product as recited in claim 15, wherein the method further includes generating a report corresponding to the first human participant's mastery of certain educational materials, and wherein generating the report includes evaluating rewards received by the first virtual game character within the virtual game environment.

20. The computer program product of claim 19, wherein the report is used to calculate a grade for the first human participant, wherein the grade corresponds to a certain subject of a school curriculum.

21. A computer program product as recited in claim 15, wherein assigning the first virtual game character to the first human participant includes identifying a profile of the first human participant and matching the profile of the first human participant with a profile of the first virtual game character.

22. A computer program product as recited in claim 15, wherein the educational materials comprise educational materials corresponding to a school curriculum.

23. A computer program product as recited in claim 15, wherein the game action further includes the first virtual game character attacking the second virtual game character by the first human participant presenting a question to the second human participant assigned to the second virtual game character such that upon the second human participant answering the question incorrectly, the second virtual game character is harmed from the attack.

24. The computer program product of claim 15 wherein the method further includes presenting multiple additional questions to the first human participant, wherein the multiple additional questions are presented by an additional virtual game character that is controlled by the virtual game environment rather than by a human participant, and wherein the multiple additional questions correspond to a school or state mandated test such that upon the first human participant answering a specified number of the questions correctly, the first human participant is deemed to have passed the school or state mandated test.

* * * * *